US005533436A

United States Patent [19]

Chuang

[11] Patent Number: 5,533,436

[45] Date of Patent: Jul. 9, 1996

[54] HAND AIR PUMP HAVING TWO ACTUATORS

[76] Inventor: Louis Chuang, 7th Floor-8, No. 20 Ta Lon Rd., Taichung, Taiwan

[21] Appl. No.: 441,349

[22] Filed: May 15, 1995

[51] Int. Cl.[6] ..... F01B 19/00

[52] U.S. Cl. ..... 92/146; 417/533; 417/521

[58] Field of Search ..... 417/63, 533, 536, 417/521; 92/58.1, 146

[56] References Cited

U.S. PATENT DOCUMENTS

| | | | |
|---|---|---|---|
| 167,366 | 8/1875 | Tyler | 417/533 |
| 785,154 | 3/1905 | Cordeau | 92/58.1 |
| 904,940 | 11/1908 | Dahberg | 92/146 |
| 1,349,218 | 8/1920 | Moon | 92/146 |
| 1,390,559 | 9/1921 | Huntley | 417/63 |
| 1,527,226 | 2/1925 | Rollins | 92/146 |
| 4,334,839 | 6/1982 | Flagg | 417/536 |

FOREIGN PATENT DOCUMENTS

| | | | |
|---|---|---|---|
| 173157 | 11/1952 | Germany | 92/58.1 |

*Primary Examiner*—Thomas E. Denion
*Attorney, Agent, or Firm*—Charles E. Baxley

[57] ABSTRACT

An air pump includes two operating rods slidably engaged in two cylinders and having an upper end extended outward of the cylinders. A block is secured to the upper ends of the operating rods. A coupler is rotatably secured to the upper portion of the block by a bolt. A hand grip includes a chamber for engaging with the coupler and is pivotally coupled to the coupler at a pivot shaft. The pivot shaft is perpendicular to the bolt so as to allow the hand grip rotating to a folded position.

1 Claim, 2 Drawing Sheets

HAND AIR PUMP HAVING TWO ACTUATORS

BACKGROUND OF THE INVENTION

1. Field of the Invention

The present invention relates to an air pump, and more particularly to a hand air pump having two actuators.

2. Description of the Prior Art

Typical hand air pumps comprise only one actuator for pumping air into tires. However, the users have to pump for a number of times so as to pump a bicycle tire.

The present invention has arisen to mitigate and/or obviate the afore-described disadvantages of the conventional air pumps.

SUMMARY OF THE INVENTION

The primary objective of the present invention is to provide a hand air pump which includes two actuators for pumping tires in a fast speed.

In accordance with one aspect of the invention, there is provided an air pump comprising two cylinders each including an operating rod slidably engaged therein, the operating rods each including an upper end extended outward of the cylinders, a block secured to the upper ends of the operating rods and including a bore formed therein, a coupler rotatably engaged on top of the block, a fastening means rotatably engaged in the bore of the block and secured to the coupler so as to rotatably couple the coupler to the block, and a hand grip including a chamber formed therein for engaging with the coupler, the hand grip being pivotally coupled to the coupler at a pivot shaft, the pivot shaft being perpendicular to the fastening means so as to allow the hand grip rotating to a folded position.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
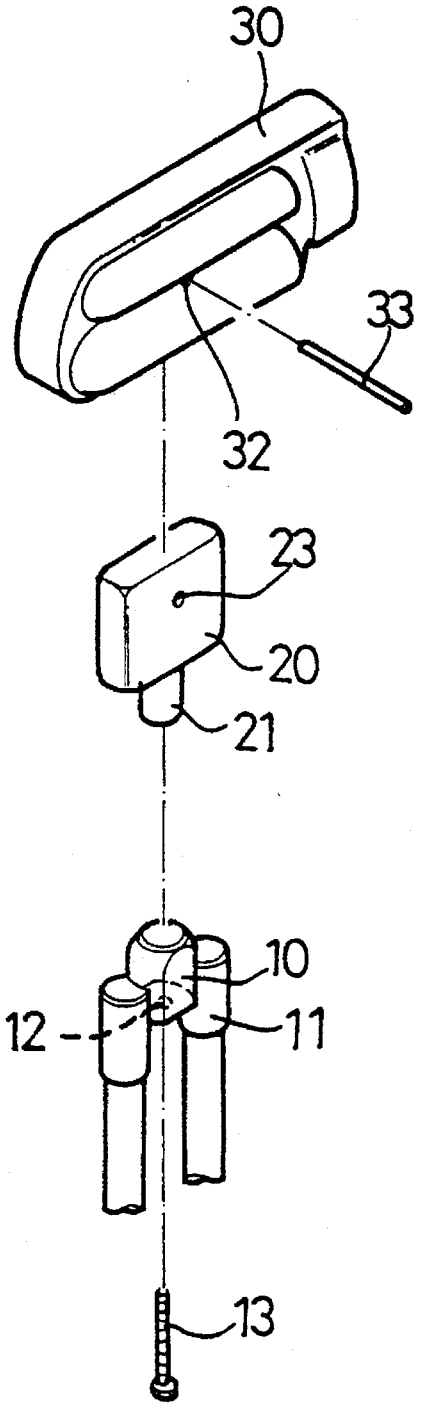
FIG. 1 is a partial exploded view of a hand air pump in accordance with the present invention.
Figure 2:
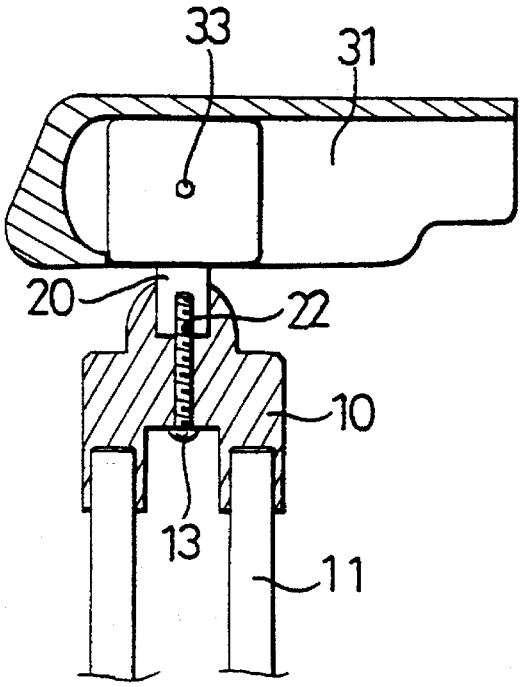
FIG. 2 is a partial cross sectional view of the hand grip to the actuators.
Figure 3:
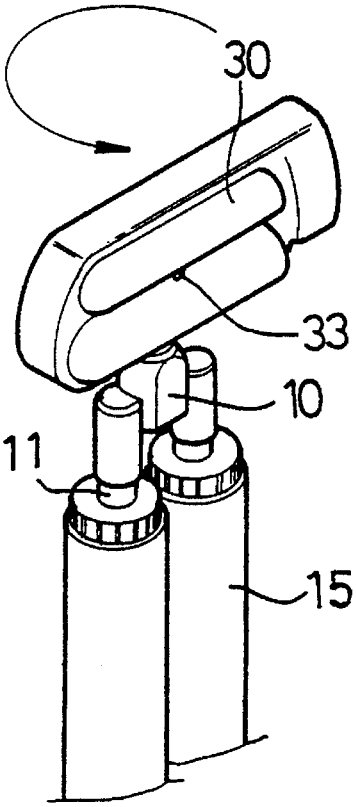
FIG. 3 is a partial perspective view illustrating the operation of the hand air pump.

Referring to the drawings, a hand air pump in accordance with the present invention comprises two cylinders 15 each including an operating rod 11 slidably engaged therein. The operating rods 11 each includes an upper end extended outward of the cylinders 15. A block 10 is secured on top of the operating rods 11 and includes a bore 12 formed therein for engaging with a bolt 13. A coupler 20 includes an extension having an inner thread 22 formed therein for engaging with the bolt 13 such that the coupler 20 is rotatable about the axis of the bolt 13. A hand grip 30 includes a chamber 31 formed therein for engaging with the coupler 20 and is pivotally coupled to the coupler 20 at a pivot shaft 33 which is engaged through the orifices 32 of the hand grip 30 and engaged through the aperture 23 of the coupler 20. The pivot shaft 33 is perpendicular to the bolt 13 such that the hand grip 30 may be rotated about the axes of both the bolt 13 and of the pivot shaft 33.

Figure 4:
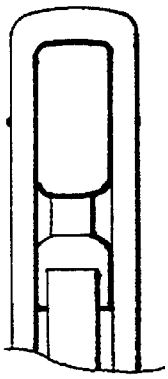
FIG. 4 is a schematic view illustrating the folding operation of the hand grip.

It is to be noted that the hand grip 30 can be rotated about the bolt 13 to suitable angular position relative to the cylinders 15 such that the hand grip 30 can be easily held in place and can be easily pumped by the users when the other hand of the user holds the cylinders 15. The hand grip 30 may also be folded to a rather compact configuration as shown in FIG. 4.

Accordingly, the hand air pump in accordance with the present invention includes two cylinders for pumping purposes, and includes a hand grip that may be rotated relative to the cylinders such that the hand grip may be easily operated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air pump comprising:

two cylinders each including an operating rod slidably engaged therein, each of said operating rods including an upper end extended outward of its cylinder, a block secured to said upper ends of each of said operating rods for actuating said operating rods simultaneously, the block including a bore formed therein, a coupler rotatably engaged on top of said block and arranged to be rotated relative to said block, a fastening means rotatably engaged in said bore of said block and secured to said coupler so as to couple rotatably said coupler to said block and so as to allow said coupler to be rotated relative to said block, and a hand grip including a chamber formed therein for engaging with said coupler, said hand grip being pivotally coupled to said coupler at a pivot shaft, said pivot shaft being perpendicular to said fastening means so as to allow said hand grip to rotate to a folded position.

* * * * *